US010010154B1

(12) United States Patent
Zhang

(10) Patent No.: US 10,010,154 B1
(45) Date of Patent: Jul. 3, 2018

(54) MOVABLE BELT MASCARA APPLICATOR APPARATUS

(71) Applicant: Derik Zhang, Liaobu Town Dongguan (CN)

(72) Inventor: Derik Zhang, Liaobu Town Dongguan (CN)

(73) Assignee: Lava Industries, Inc., Monterey Park, CA (US)

( * ) Notice: Subject to any disclaimer, the term of this patent is extended or adjusted under 35 U.S.C. 154(b) by 0 days.

(21) Appl. No.: 14/545,037

(22) Filed: Mar. 19, 2015

Related U.S. Application Data

(63) Continuation-in-part of application No. 13/987,166, filed on Jul. 8, 2013, now Pat. No. 9,572,413.

(51) Int. Cl.
*A45D 40/26* (2006.01)

(52) U.S. Cl.
CPC ..... *A45D 40/264* (2013.01)

(58) Field of Classification Search
CPC ..... A45D 40/26; A45D 40/262; A45D 40/264–40/267; A45D 24/02; A45D 2200/10
USPC ..... 401/175, 208, 219
See application file for complete search history.

(56) References Cited

U.S. PATENT DOCUMENTS 2,057,085 A * 10/1936 Danco ..... A45D 40/02 206/385
6,220,254 B1 * 4/2001 Gueret ..... A45D 40/267 132/218
7,946,780 B2 5/2011 Zhang
2011/0262208 A1 * 10/2011 Edmondson ..... A45D 34/04 401/146

* cited by examiner

*Primary Examiner* — Todd E Manahan
*Assistant Examiner* — Brianne Kalach
(74) *Attorney, Agent, or Firm* — William W. Haefliger

(57) ABSTRACT

A mascara application device, comprising a container for mascara a manually operable actuator, feed mechanism carried by the container to feed mascara to a loading station, in response to operation of the actuator, a belt having applicator brushes to receive mascara at the loading station as the actuator is operated, guide means to guide actuator induced belt displacement relative to the container to position the brushes for mascara application to eye lashes.

14 Claims, 9 Drawing Sheets

FIG. 17
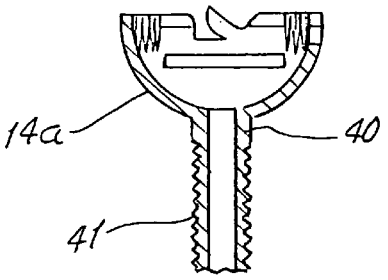
FIG. 18
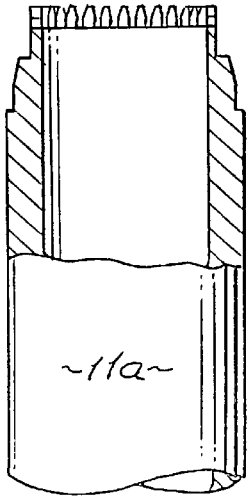
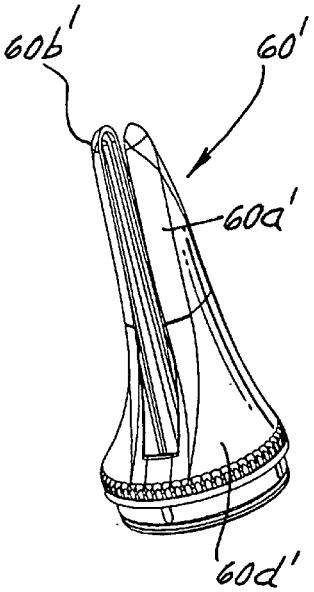
FIG. 19

MOVABLE BELT MASCARA APPLICATOR APPARATUS

This application is a continuation-in-part of Ser. No. 13/987,166, filed Jul. 8, 2013.

BACKGROUND OF THE INVENTION

This invention relates generally to controlled feeding application of cosmetic liquid, such as mascara, to eye lashes or to other facial zones; and more particularly relates to an improved device to feed mascara from a container onto brushes on a belt, at controlled rate, as for example as related to desired delivery of mascara to eye lashes.

There is need for simple, compact, easily manually controlled and operated devices that accurately deliver mascara to eye zones, at controlled rates. Prior devices lacked the related integrated improvements, in a highly compact assembly characterized by the present invention.

SUMMARY OF THE INVENTION

It is a major object of the invention to provide an improved, compact, mascara application device that basically comprises:

a) a container for mascara b) a manually operable actuator, c) feed mechanism carried by the container to feed mascara to a loading station, in response to operation of the actuator, d) a belt having applicator brushes to receive mascara at the loading station as the actuator is operated, e) guide means including ring structures to guide actuator induced belt displacement relative to the container to position the brushes for mascara application to eye lashes.

As will be seen, the belt is typically a compact, endless belt; the mechanism includes an actuator that is manually controllably rotatable; and the actuator is operatively coupled to both the feed mechanism and to the belt whereby the user may simultaneously control both displacement of mascara fluid onto the belt, and belt brush displacement relative to the user's eye lashes for accurate control of mascara application.

Another object is to provide a spindle, and first gearing associated with the spindle to rotate the spindle about a transverse axis as the actuator is manually rotated about a longitudinal axis, and second gearing associated with the spindle and belt to drive the belt endwise in response to said spindle rotation. Such first gearing may advantageously include interengaged teeth on an actuator part and extending about the longitudinal axis, and teeth on the spindle extending about the transverse axis. Also, the second gearing typically includes gear teeth on the belt at its inner side, with belt brushes presented at the belt outer side.

In a modification, a guide sleeve interfits (extends about) and centers a ring to assure rotary drive thereto, in response to manual rotation of an actuator, which also interfits the sleeve. Further, the actuator is rotated, it displaces a pusher in a mascara container to in turn displace or feed mascara to loading station, there being a belt having applicator brushes to receive mascara at the loading station.

These and other objects and advantages of the invention, as well as the details of an illustrative embodiment, will be more fully understood from the following specification and drawings, in which:

DRAWING DESCRIPTION

Figure 15:
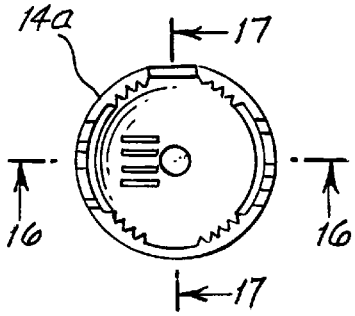
FIG. 15 is an end view of actuator part that is rotatable to displace the fluid pusher.
Figure 14:
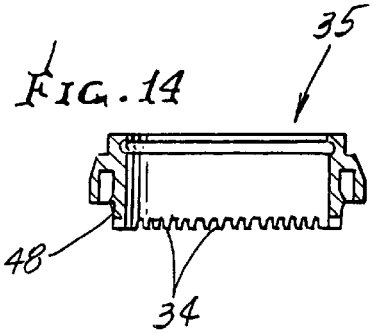
FIG. 14 is a section taken on lines 14-14 of FIG. 13.
Figure 16:
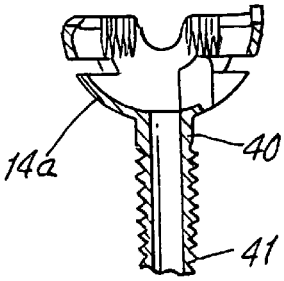

FIG. 16 section taken on lines 15-15 of FIG. 15*p*

Figure 7:
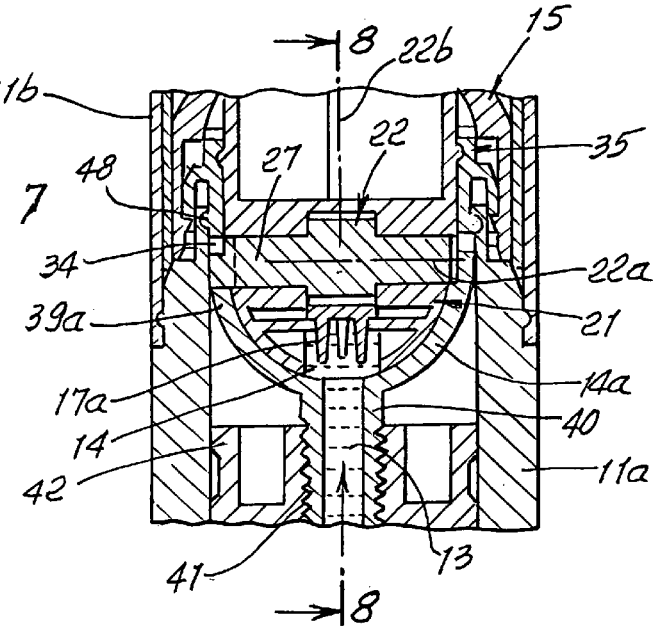
FIG. 7 is an enlarged fragmentary vertical section taken through elements of the belt driver which also drives a fluid pusher to supply fluid to the belt.
Figure 8:
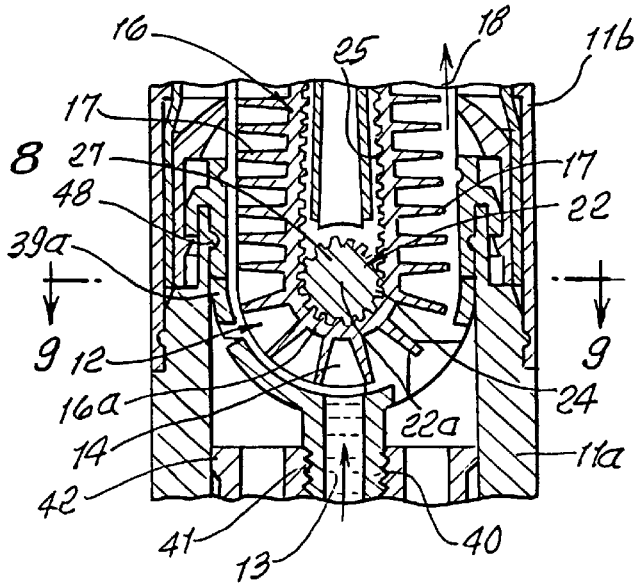
FIG. 8 is a vertical section taken on lines 8-8 of FIG. 7.
Figure 9:
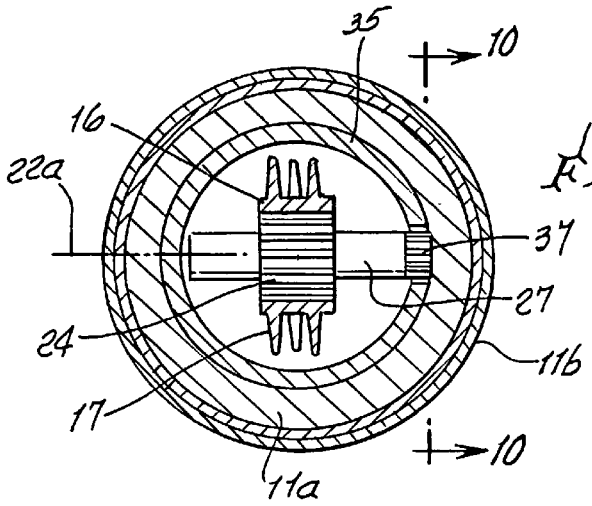
FIG. 9 is a horizontal section taken on lines 9-9 of FIG. 8.
Figure 21:
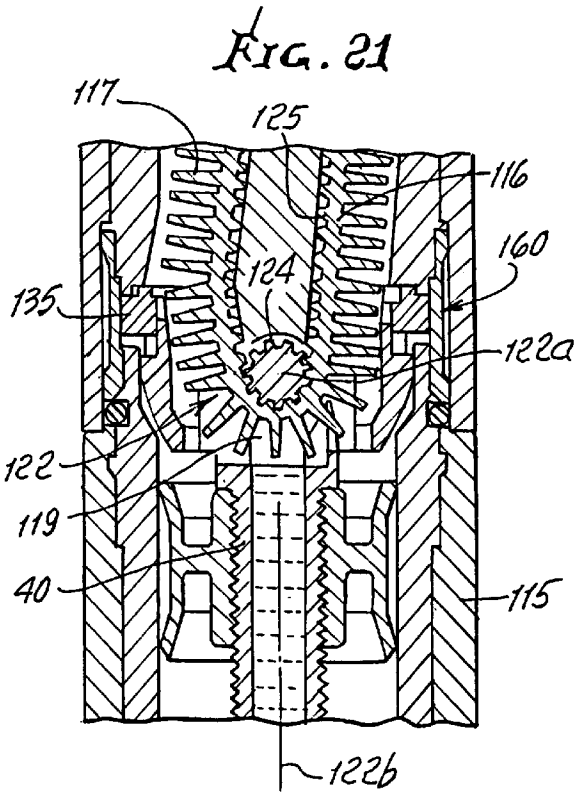
Figure 20:
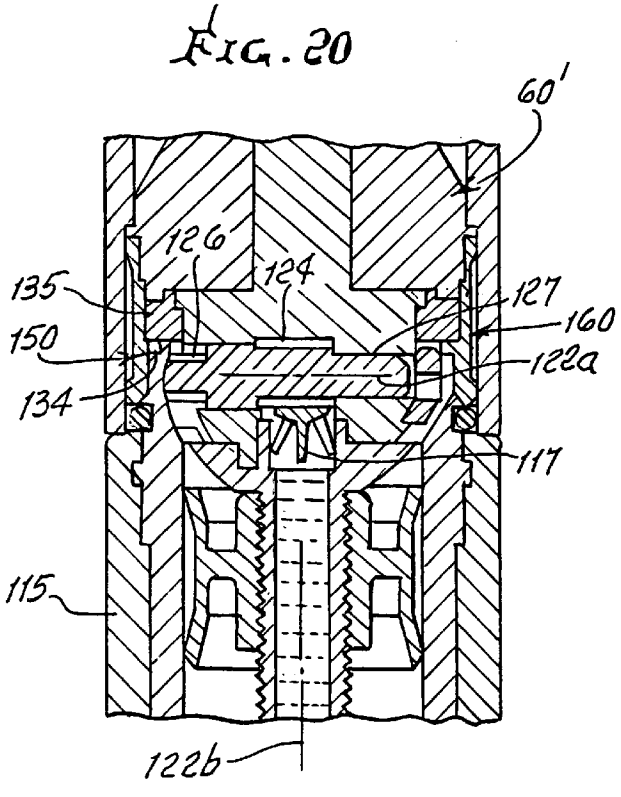
Figure 22:
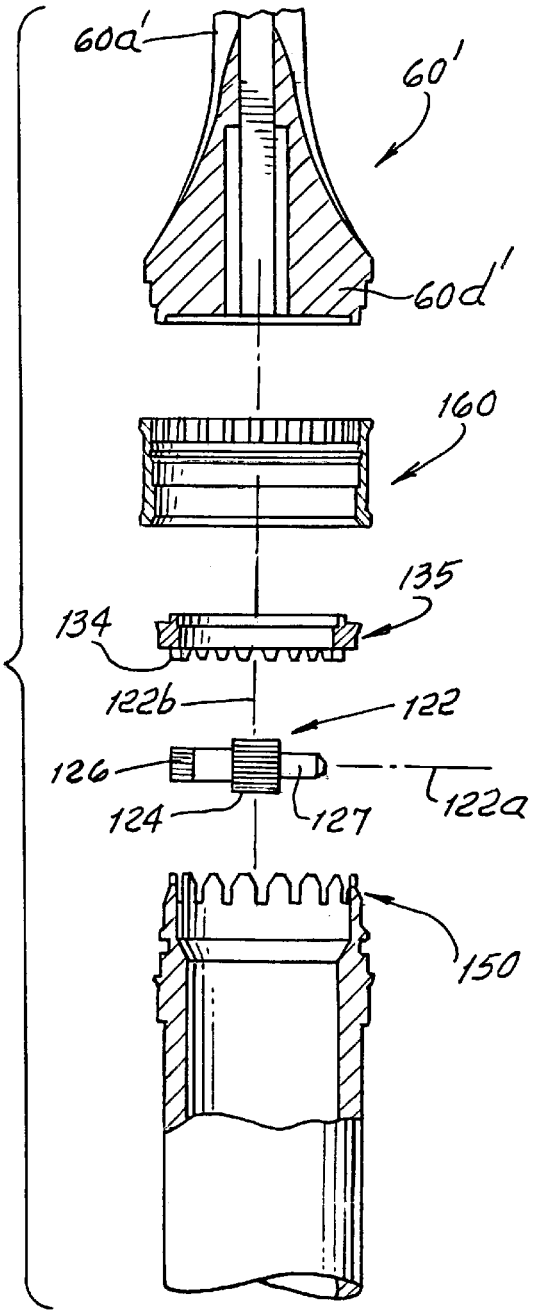

FIG. 17 is a section taken on lines 17-17 of FIG. 15;

FIG. 18 is a fragmentary elevation showing support body structure;

FIG. 19 is a modified perspective view showing construction of driver structure that supports and positions the belt that carries applicator brushes;

FIGS. 20-21 show details of a modification, FIGS. 20 and 21 corresponding to FIGS. 7 and 8; and FIG. 22 being an exploded view of the modification.

DETAILED DESCRIPTION

Figure 1:
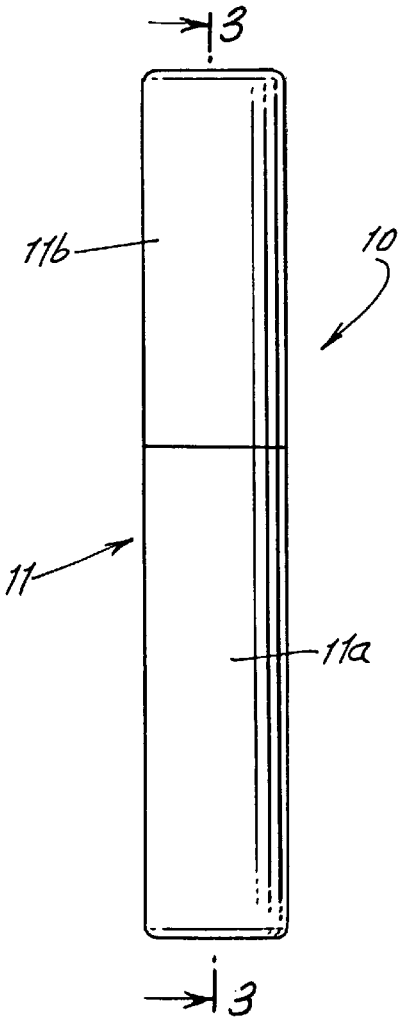
FIG. 1 is a side elevation view of apparatus embodying the invention.
Figure 2:
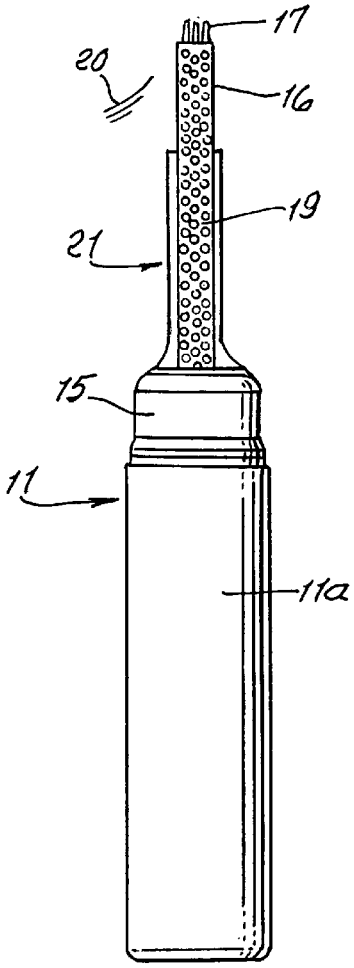
FIG. 2 is a view like FIG. 1, with a cap removed and showing brushes ready for use.
Figure 3:
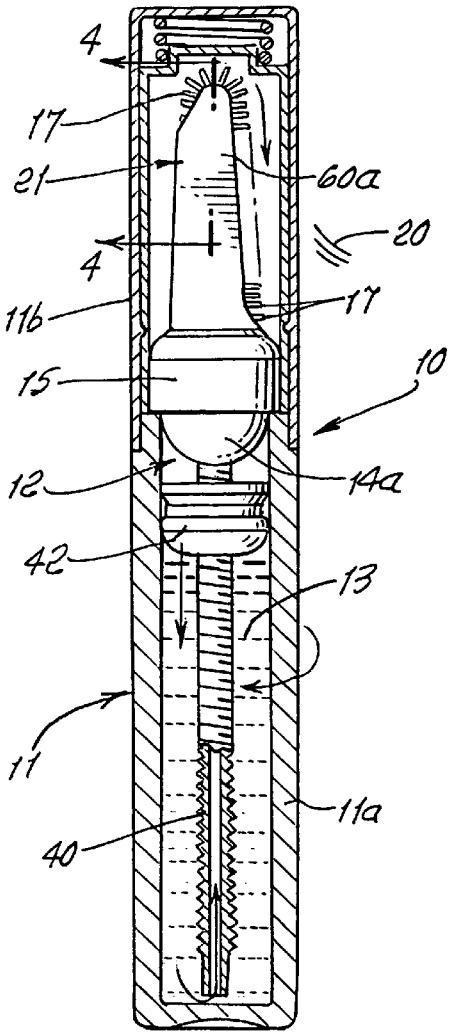
FIG. 3 is a vertical section taken on lines 3-3 of FIG. 1.
Figure 4:
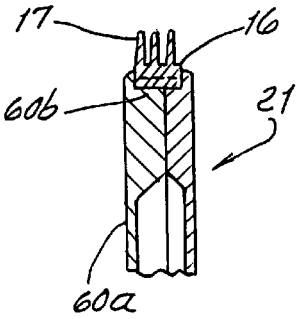
FIG. 4 is a fragmentary vertical section taken on lines 4-4 of FIG. 3.

Referring first to FIGS. 1-3, they show a representative mascara application device 10 that includes, generally, a container 11 for liquid mascara having a main body 11*a* and a cap 11*b* fitting endwise toward body 11*a*, and being endwise removable. Feed mechanism shown generally at 12 is carried by the container to feed mascara 13 in body 11*a* to a loading station or zone indicated at 14 in FIG. 8 in response to operation, such as rotation of a manually rotatable actuator 15, after removal of cap 11*b*.

An endless belt 16 has or carries applicator brushes 17 which, at the loading zone 14, receive or pick up mascara fluid as the actuator is operated, for travel indicated by arrow 18 away from body 11*a* and toward zone 19 exposed to the exterior, for application to the user's eye lashes 20, as the user manually manipulates the hand held container body 11*a*. Belt travel or endwise displacement is guided by elongated guide means or structures indicated generally at 21 FIG. 8 shows belt drive gear 22 rotatable about transverse axis 22*a*, in response to rotation of the actuator 15, about longitudinal axis 22*b*. Gear teeth 24 engage internal gear teeth 25 integral with the belt, to drive the belt. Gear teeth 34 on the actuator sleeve 35 engage gear teeth 36 on the spindle 27. Spindle 27 is rotatable about axis 22*a*.

In the simplified, more compact modification shown in FIGS. 19-22, an annular, belt drive gear 122 is rotatable about traverse axis 122*a* in response to rotation of 115 about longitudinal axis 122*b*. Gear teeth 124 engage internal gear teeth 125 integral with the belt 116, to drive the belt. Gear teeth 134 on the actuator ring 135 engage gear teeth 126 on the transversely extending spindle 127. A guide sleeve 160 interfits (extends about) and centers ring 135, at 160*a* to assure rotary drive thereto, in response to manual rotation of actuator 150, which also interfits the sleeve 160 at 160*b*.

Accordingly, in FIGS. 20 and 21, first gearing is provided at 134 on ring 135 to rotate a spindle about a transverse axis 122*a* in response to actuator 150 rotation about a longitudinal axis 122*b*; and second gearing 124 and 125 is provided to advance the belt longitudinally in response to said spindle rotation. More specifically, first gearing 124 and 125 is associated with the spindle to rotate the spindle about transverse axis 122*a* as the actuator is manually rotated about a longitudinal axis 122*b*, and second gearing 124 and 125 is associated with the spindle and belt to drive the belt endwise in response to such spindle rotation. Also, the second gearing includes gear teeth 125 on the belt inner side, belt brushes 117 being presented at the belt outer side. Also, the first gearing includes interengageable teeth on an actuator part and extending about said longitudinal axis and the teeth on the spindle. Further, guide structure such as ring or sleeve 160 and ring 135 is or are provided to guide actuator induced belt displacement relative to the container to position the brushes for mascara application to eye lashes.

FIG. 8 shows cup shaped loading zone 14 formed by the actuator, into which the lowermost end portion 16*a* of the belt 16 dips, to enable bristles or brushes 17 to scoop up liquid mascara to be transported to the eyelash application zone 19, as the belt is advanced endwise and turns 180° in cup 14*a*. Liquid mascara is proportionally delivered toward the zone 19 as the actuator is rotated, the cup zone 14 forming a 180° turn brush guide. See also loading zone 119 in FIG. 21. Such actuator rotation also rotates a mascara delivery tube 40, having threaded engagement at 41 with a pusher piston 42 in the container body. As the tube 40 rotates, the piston 42 is driven downwardly in the container body interior, to push mascara into and upwardly in the tube 40, for upwardly supply to the loading zone 14, in a delivery amount proportioned to mascara pick-up by the belt bristles projecting at 17*a* into the loading zone. FIGS. 7 and 8 also show the actuator rotatable wall 35 having connection at 48 both to wall 39*a* of cup 14*a*, and to the threaded tube 40.

Figure 10:
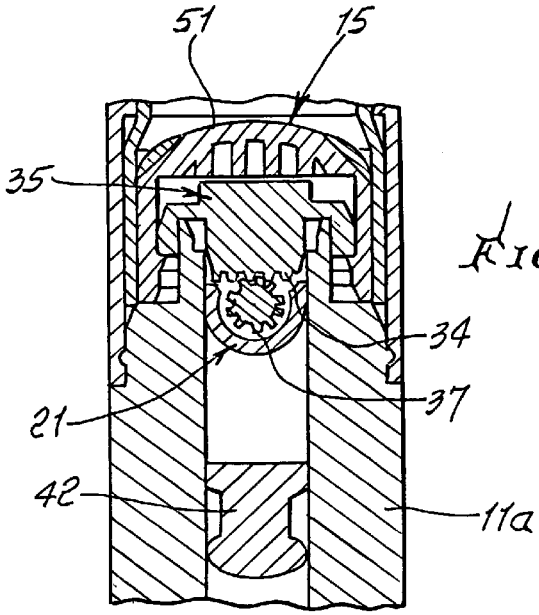
FIG. 10 is a vertical section taken on lines 10-10 of FIG. 9.
Figure 11:
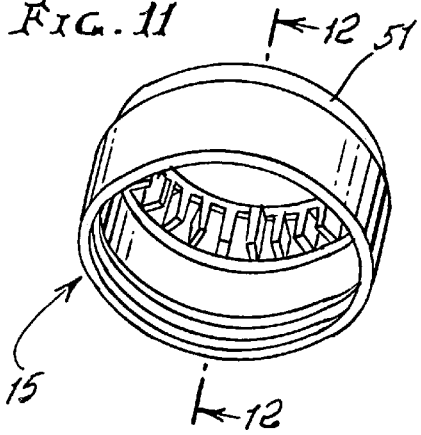
FIG. 11 is a perspective view showing a driver actuator.
Figure 13:
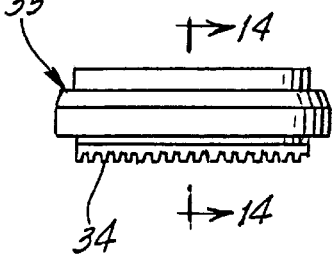
FIG. 13 is an elevation view showing a rotary actuator element that rotates the spur gear shown in FIGS. 9 and 10.
Figure 12:
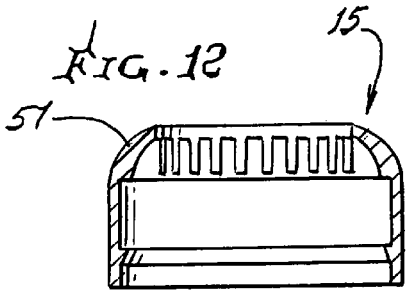
FIG. 12 is a section taken on lines 12-12 of FIG. 11.

FIG. 10 shows a top end wall 51 of the tubular actuator.

Figure 5:
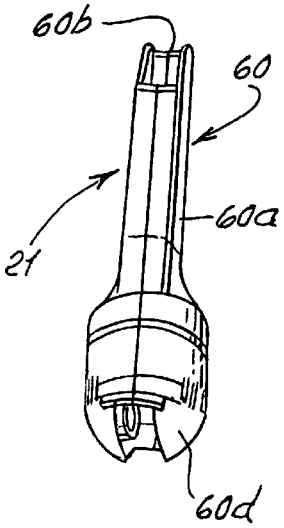
FIG. 5 is a perspective view showing a brush belt driver.

FIG. 5 shows the housing 60 acting as guide means for the driving and driven elements. Elongated portion 60*a* of the housing extends protectively at one side of the belt, and terminates at 60*b* to guide the belt extent 16*a* in an exposed reversing travel path at the end of the belt housing. Lowermost extent 60*d* of the housing fits adjacently to the upper extent of the actuator.

Figure 6:
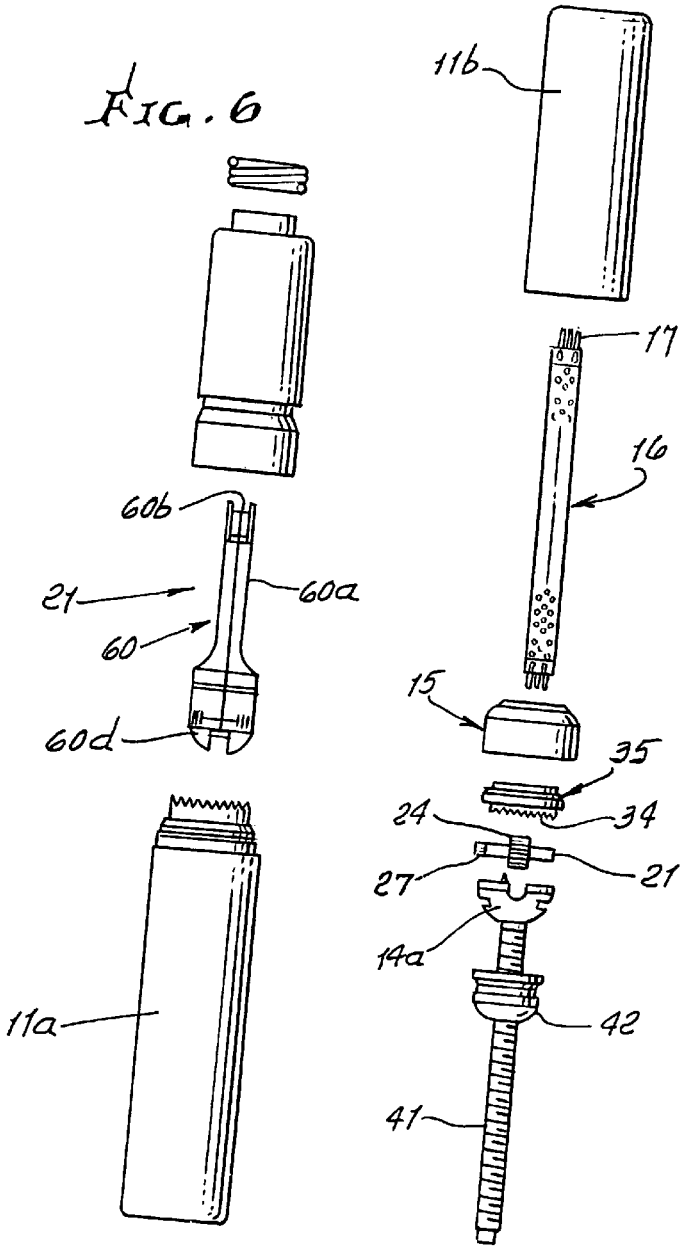
FIG. 6 is an exploded elevation showing positioning of the driver between the cap and body of the apparatus.

In FIG. 19 elements 60', 60*a*' and 60*b*' corresponds to elements 60, 60*a* and 60*b* in FIG. 6. Base extent 60*a*' is ring shaped and diverges downwardly toward teeth 61' or protuberances spaced annularly about the longitudinal axis of the elongated base extent.

I claim:

1. A mascara application device, comprising a) a container for mascara b) a manually operable actuator, c) feed mechanism carried by the container to feed mascara to a loading station, in response to operation of the actuator, d) a belt having applicator brushes to receive mascara at the loading station as the actuator is operated, e) guide means including ring structure is provided to guide actuator induced belt displacement relative to the container to position the brushes for mascara application to eye lashes, f) said belt being an endless elongated belt, said actuator being rotatable about an axis which extends in the direction of belt elongation, g) said loading station being configured to receive liquid displaced by a pusher in the container, in response to actuator rotation.

2. The device of claim 1 wherein the actuator is operatively coupled to both said feed mechanism and to the belt.

3. The device of claim 1 wherein said belt is a plastic belt with plastic bristles, the belt extending generally lengthwise at one end of the container, which is elongated to be hand held, whereby that bristles face sidewardly relative to the container.

4. The device of claim 1 including first gearing operatively coupled between said actuator and said belt.

5. The device of claim 1 including a liquid mascara pusher in said container, and a driver operatively coupled between said actuator and said pusher.

6. The device of claim 5 wherein said driver includes rotary gearing.

7. The device of claim 6 including other gearing operatively coupled between said actuator and said belt.

8. The device of claim 7 wherein said actuator is rotatable about an axis which extends in the direction of belt elongation.

9. The device of claim 1 which includes:

f) a spindle, and g) first gearing associated with the spindle to rotate the spindle about a transverse axis as the actuator is manually rotated about a longitudinal axis, h) second gearing associated with the spindle and belt to drive the belt endwise in response to said spindle rotation, i) said ring structure associated with said first gearing.

10. The device of claim 9 wherein said second gearing includes gear teeth on the belt at its inner side, belt brushes presented at the belt outer side.

11. The device of claim 10 wherein said first gearing includes interengageable teeth on an actuator part and extending about said longitudinal axis, and teeth on the spindle extending about said transverse axis.

12. A mascara application device, comprising a) a container for mascara b) a manually operable actuator, c) feed mechanism carried by the container to feed mascara to a loading station, in response to operation of the actuator, d) a belt having applicator brushes to receive mascara at the loading station as the actuator is operated, e) guide means to guide actuator induced belt displacement relative to the container to position the brushes for mascara application to eye lashes, f) a spindle, and g) first gearing associated with the spindle to rotate the spindle about a transverse axis as the actuator is manually rotated about a longitudinal axis, h) second gearing associated with the spindle and belt to drive the belt endwise in response to said spindle rotation, j) there being a guide sleeve extending about said first gearing to center its rotation, that sleeve also extending into centering relation into said container, k) said loading station is configured to receive liquid displaced by a pusher in the container, in response to actuator rotation.

13. The device of claim 12 wherein said guide sleeve extends about said spindle.

14. The device of claim 12 including an annular seal sealing off between said sleeve and said container for mascara.

* * * * *